United States Patent [19]

Stoll

[11] 4,157,134

[45] Jun. 5, 1979

[54] BAG WITH LIFE PRESERVING BUOYANT MEANS

[76] Inventor: Charles Stoll, 8 Langereis Dr., Monsey, N.Y. 10952

[21] Appl. No.: 903,833

[22] Filed: May 8, 1978

[51] Int. Cl.[2] ..... A45C 9/00

[52] U.S. Cl. ..... 190/1; 9/312; 190/42

[58] Field of Search ..... 9/312, 313, ; 190/1, 190/42; 150/35

[56] References Cited

U.S. PATENT DOCUMENTS

| | | | |
|---|---|---|---|
| 150,617 | 5/1874 | Roos | 9/312 X |
| 234,606 | 11/1880 | Oatman | 9/312 X |
| 784,933 | 3/1905 | Fisch | 9/312 X |
| 2,542,477 | 2/1951 | Cart | 9/312 X |
| 2,865,433 | 12/1958 | Warner | 190/42 |
| 3,143,748 | 8/1964 | Manning | 190/1 |
| 3,152,343 | 10/1964 | Brown | 9/312 |

*Primary Examiner*—Donald F. Norton
*Attorney, Agent, or Firm*—Howard I. Podell

[57] ABSTRACT

A combination bag and float wherein the bag has a pair of generally semi-circular floatation elements containing foamed plastic hinged to its bottom. The elements have an outer reflective surface and handles. Adhesive means such as mating Velcro bands secure the inner surface of the elements to the outside of the bag. A strap is secured to the upper ends of the bag for carrying the assembly and is adjustable about the waist of the user when the floatation elements are opened to use. The bag serves as a rudder and stabilizer. Preferably, the bag and its floatation elements have a coating of fluorescent material to allow seeing same from a distance and at night.

6 Claims, 3 Drawing Figures

BAG WITH LIFE PRESERVING BUOYANT MEANS

FIELD OF THE INVENTION

This invention relates generally to a combination bag and float or buoy and pillow.

DESCRIPTION OF THE PRIOR ART

The prior art, as exemplified by U.S. Pat. Nos. 1,864,648; 784,933; 1,448,460; 407,625; and 234,606 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a combination bag and float wherein the bag has a pair of generally semi-circular floatation elements containing foamed plastic hinged to its bottom. The elements have an outer reflective surface and handles. Adhesive means such as mating Velcro bands secure the inner surface of the elements to the outside of the bag. A strap is secured to the upper ends of the bag for carrying the assembly and is adjustable about the waist of the user when the floatation elements are opened to use. The bag serves as a rudder and stabilizer. Preferably, the bag and its floatation elements have a coating of fluorescent material to allow seeing same from a distance and at night.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
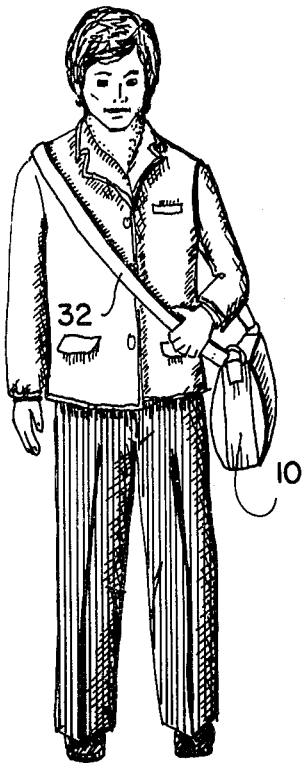
FIG. 1 is a view in perspective of the life preserving bag shown worn for street use.
Figure 2:
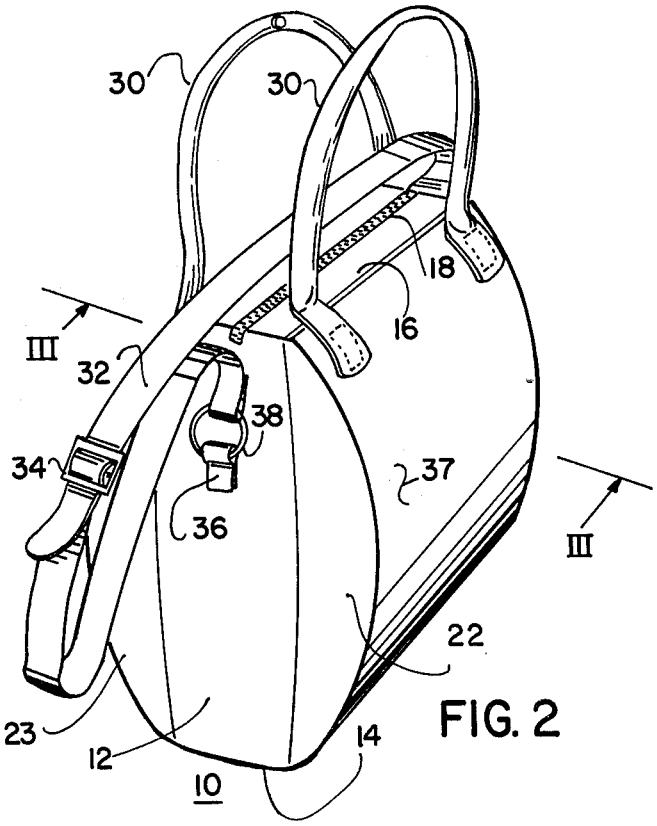
FIG. 2 is a perspective view thereof.

With reference to the drawing, there is shown and illustrated a bag with life preserving buoyant means and constructed in accordance with the principles of the invention and designated generally by reference character 10. The illustrated tangible embodiment of the invention includes a waterproof bag 12 made of plastic or rubberized canvas or the like with a flat bottom 14 and a generally flat openable top 16 provided with zipper closure 18. Closure 18 has water-tight side members 20 such that when closed the bag does not allow entry of water therein. A pair of generally semi-circular floatation members 22, 23 containing foam such as "Styrofoam" are secured at their lower ends by hinges 26 to the bottom of bag 12. Hinges 26 extend for the entire widths of bottom 14 and members 22, 23 which all have the same width.

Figure 3:
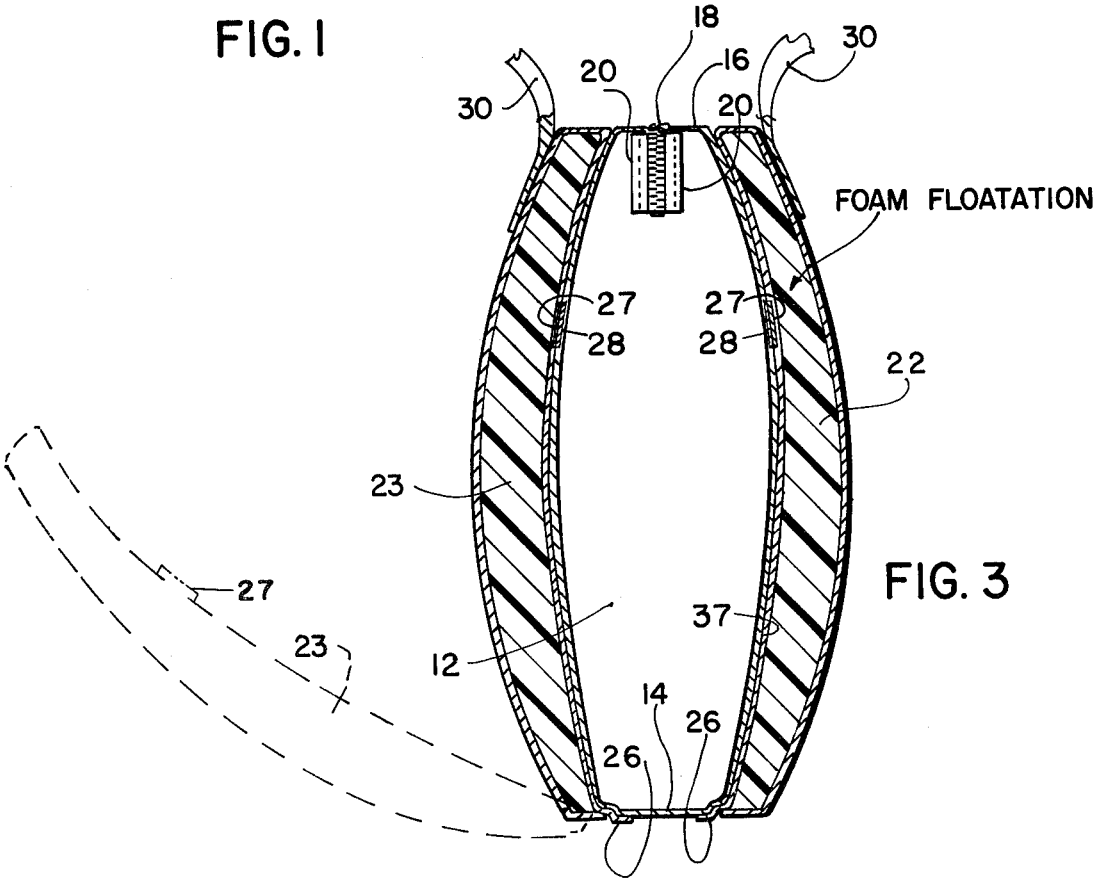
FIG. 3 shows a section through line III—III of FIG. 2, one floatation member being shown open in phantom lines.

Mating fastening means normally secure the outer lateral surfaces of bag 12 to the inner surfaces of members 22 and 23. Such means can consist of strips of mating "Velcro" material 27 and 28. The strips of material 27 and 28 respectively consist of a pile of curly fabric material in the form of kinky strands and a plurality of closely associated rows of flexible resilient plastic loop hook members respectively of the type disclosed in U.S. Pat. No. 3,063,718 issued on Nov. 13, 1962 to one Frederick E. Steincamp. The strips of material 26 and 28 cooperate such that when they are pressed against one another they become entangled and can be freed by pulling them apart such that the members 22, 23 can extend longitudinally from bag 12 as shown in FIG. 3 in the case of member 23 by dashed lines.

Handles 30 are stitched or otherwise secured to the upper ends of members 22, 23. An adjustable strap 32 provided with buckle 34 has its extremities secured to the sides of bag 12. Preferably, one end of strap 32 is secured to loop 36 on bag 12 through ring 38.

Bag 12 can have the usual internal construction of handbags and the like.

To use the device as a life preserver, the floatation members 22, 23 are pulled horizontally away from bag 12 and strap 32 is tightened about the waist or the shoulders depending on the size of the user. The handles 30 may be gripped for better maneuverability. Bag 12 will point down into the water under the weight of the user and serves as a rudder and a stabilizer. Preferably, a fluorescent material 37 is externally coated on bag 12 and members 22, 23.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A bag with life preserving buoyant means comprising a waterproof bag; a pair of buoyant floatation members, each externally hinged to said bag; mating detachable fastening means for securing said members to the sides of said bag; with a handle fixed on each said member.

2. The invention as recited in claim 1, wherein said fastening means consist of mating "Velcro" bands.

3. The invention as recited in claim 1, wherein said members are hinged at their lower ends to the bottom of said bag.

4. The invention as recited in claim 1, wherein said bag and said members have a coating of fluorescent material.

5. The invention as recited in claim 1 in which the bag is formed with an opening that is fitted with water-tight closure means.

6. The invention as recited in claim 1 in which a strap is secured externally to the bag in a manner so as to permit the wearer to secure the bag by the strap to his person on land when the buoyant members are fastened against the sides of the bag in the closed position of the assembly of the bag and the buoyant members, by hanging said strap about a shoulder of the person.

* * * * *